United States Patent [19]

Horiuchi et al.

[11] Patent Number: 4,701,044

[45] Date of Patent: Oct. 20, 1987

[54] IMAGE RECORDING APPARATUS FOR COMPOSING PLURAL PARTIAL ORIGINAL IMAGES INTO A SINGLE COMPOSITE IMAGE

[75] Inventors: Tatsumi Horiuchi, Hino; Seitaro Kasahara; Akira Sawaki, both of Hachioji, all of Japan

[73] Assignee: Konishiroku Photo Ind. Co., Ltd., Tokyo, Japan

[21] Appl. No.: 821,452

[22] Filed: Jan. 22, 1986

[30] Foreign Application Priority Data

| | | | |
|---|---|---|---|
| Jan. 29, 1985 | [JP] | Japan | 60-16308 |
| Jan. 29, 1985 | [JP] | Japan | 60-16311 |
| Jan. 29, 1985 | [JP] | Japan | 60-16314 |
| Apr. 4, 1985 | [JP] | Japan | 60-72219 |

[51] Int. Cl.[4] ..... G03G 15/00

[52] U.S. Cl. ..... 355/7; 355/14 R; 355/14 E

[58] Field of Search ..... 355/7, 3 R, 14 R, 60, 355/14 C, 8, 14 E

[56] References Cited

U.S. PATENT DOCUMENTS

| | | | |
|---|---|---|---|
| 4,260,248 | 4/1981 | Murata et al. | 355/60 |
| 4,346,982 | 8/1982 | Nakajima et al. | 355/3 R |
| 4,378,156 | 3/1983 | Yajima et al. | 355/7 |
| 4,521,096 | 6/1985 | Suganuma et al. | 355/7 X |
| 4,582,417 | 4/1986 | Yagasaki et al. | 355/7 |
| 4,616,269 | 10/1986 | Mori | 355/7 X |

FOREIGN PATENT DOCUMENTS

| | | | |
|---|---|---|---|
| 56-158347 | 12/1981 | Japan . | |
| 59-15948 | 1/1984 | Japan . | |
| 59-93440 | 5/1984 | Japan | 355/7 |
| 59-87470 | 5/1984 | Japan | 355/7 |
| 2011647 | 7/1979 | United Kingdom . | |

*Primary Examiner*—A. C. Prescott

*Attorney, Agent, or Firm*—Frishauf, Holtz, Goodman & Woodward

[57] ABSTRACT

An image recording system capable of recording a composite image composed of a plurality of partial recording image areas comprises an electrically chargeable image carrier. Image recording area coordinate data is fed into the system to define an area to be recorded and/or image eliminating area coordinate data is fed into the system to define an area to be eliminated. Thereafter, a charge in the charged area of the image carrier is eliminated according to the recording area coordinate area. The same process is carried out for a plurality of desired areas of image data to produce a composite image.

20 Claims, 30 Drawing Figures

FIG. 1-a
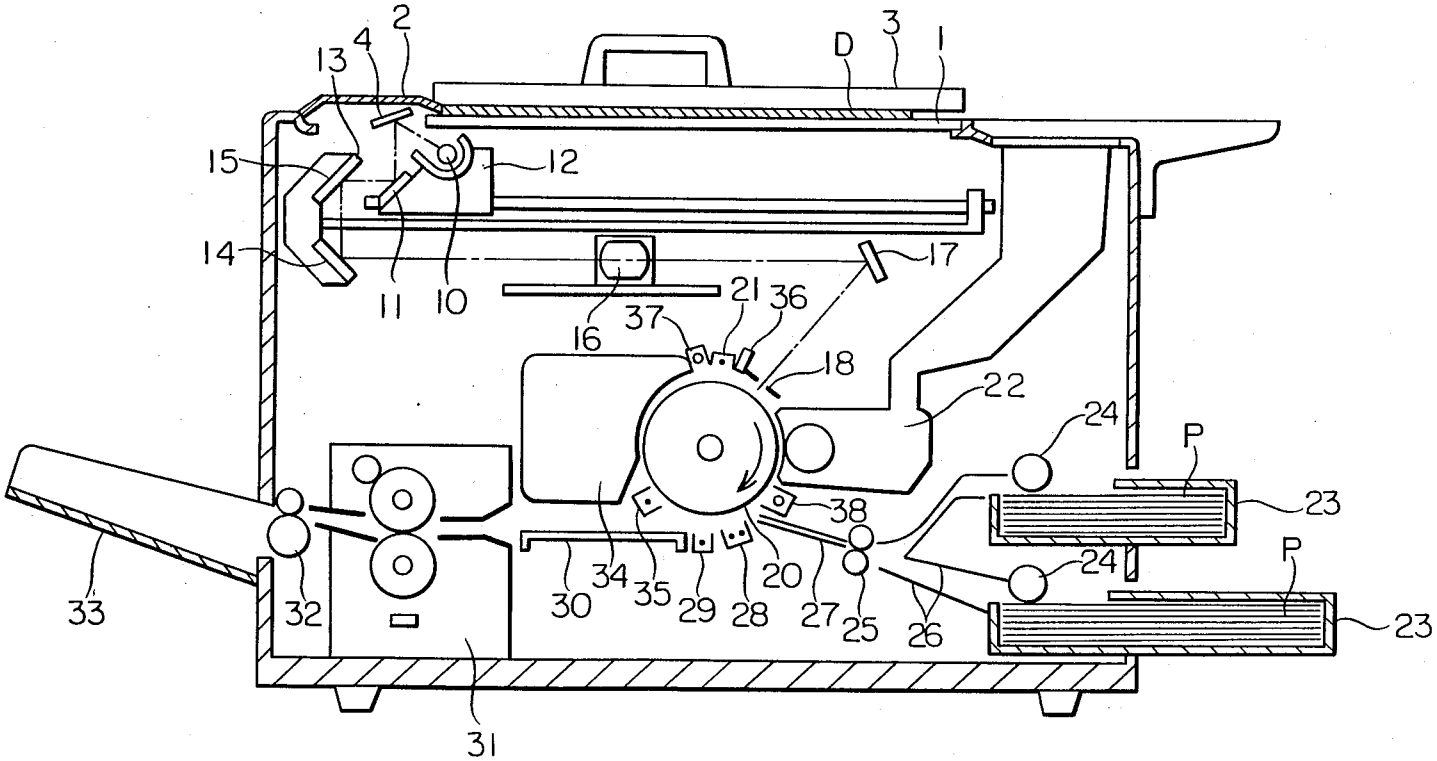

FIG. 1-b
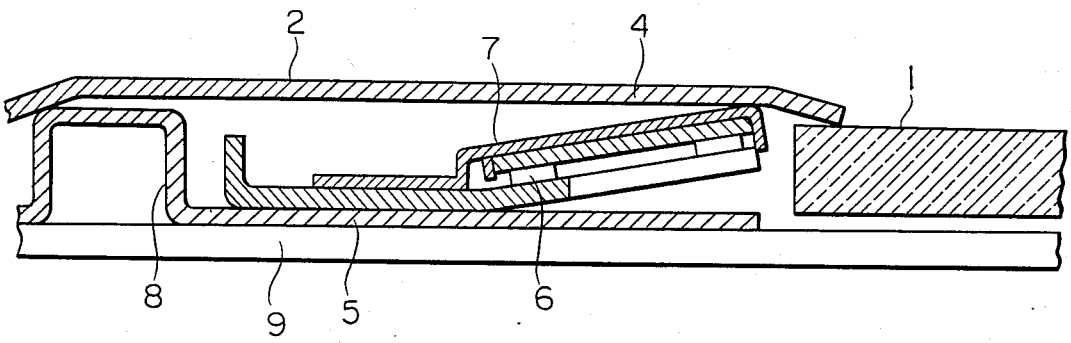
FIG. 1-c
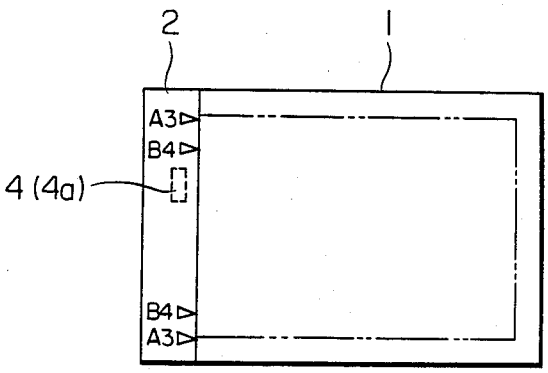

FIG. 1-d
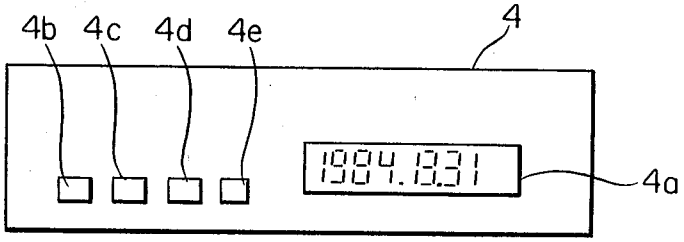
FIG. 1-e
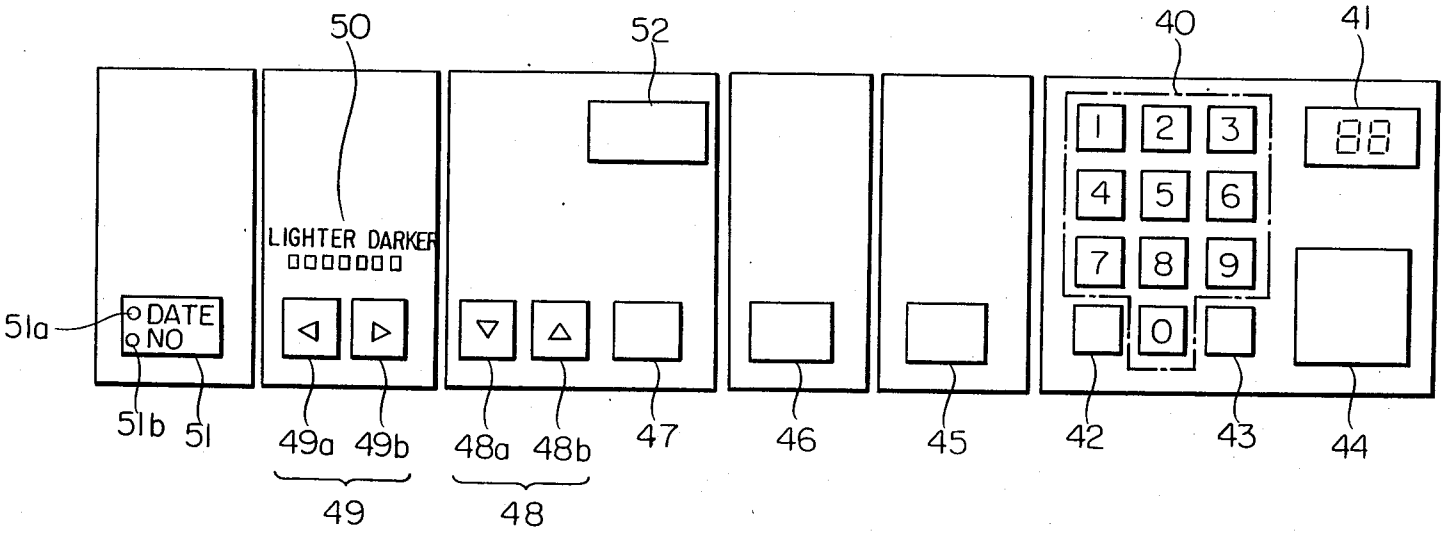

FIG. 20
(a)
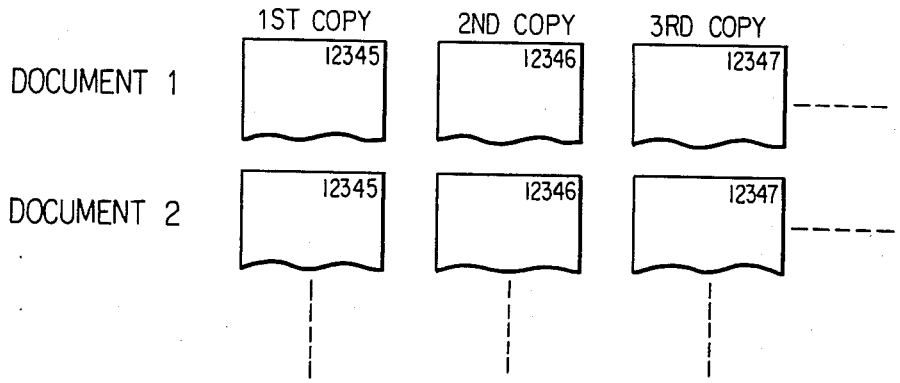
(b)
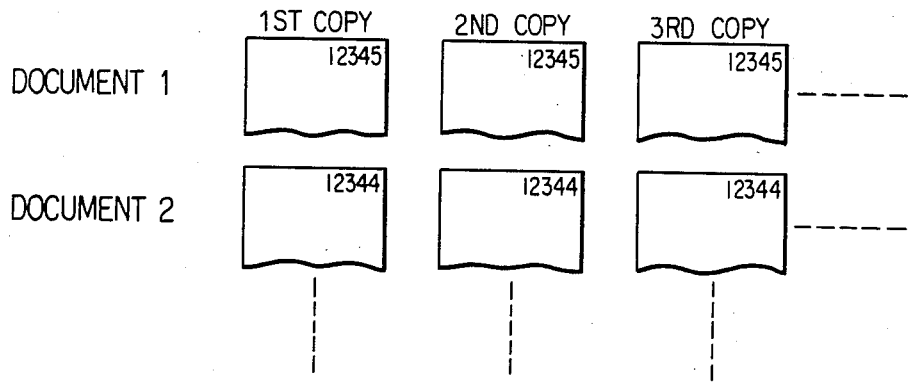
FIG. 21
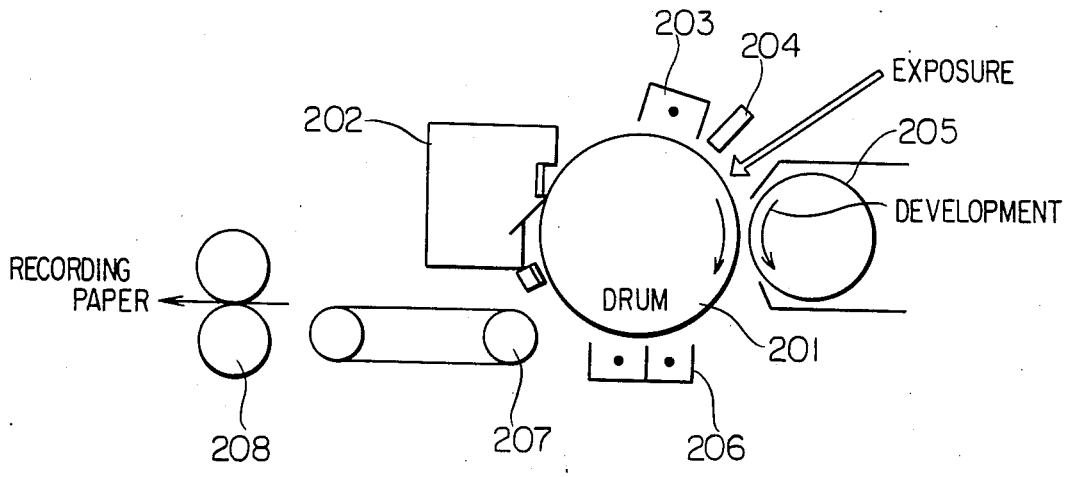

IMAGE RECORDING APPARATUS FOR COMPOSING PLURAL PARTIAL ORIGINAL IMAGES INTO A SINGLE COMPOSITE IMAGE

BACKGROUND OF THE INVENTION

The present invention relates to an image recording apparatus particularly used as a copying apparatus, and more particularly to a composite image-reproducible copying apparatus having an image composing device capable of composing a trimmed image and a masking image into a composite image.

The present invention relates also to a copying apparatus capable of copying an additional information such as a date along with an original document information simultaneously.

For example, an electronic copying apparatus of the electrophotographic process is an apparatus in which the photoreceptor drum thereof is charged and exposed to the light reflected from an original document information, and the electrostatic latent image formed on the drum surface is developed by a toner into a visible toner image, which is then transferred onto a sheet of recording paper. Electronic copying apparatus of this type has lately been extensively used for copying information in all industrial fields. And most of the latest electronic copying apparatus has a zooming function for enlargement/reduction copying of images in addition to the function of automatically making a set number of copies.

Further, recently, electronic copying apparatus equipped with an autodating function besides the above functions has made its appearance. Electronic copying apparatus of this type has a date display section such as of liquid crystal underneath its document glass plate's scale plate so that the date display image can be copied along with document information.

FIG. 21 is a drawing showing the construction of conventional electronic copying apparatus of this type. If an operator depresses the copying start button (not shown), the apparatus shown in the drawing then starts its copying operation. A photoreceptor drum 201 that revolves in the direction of the arrow, after the residual toner on the drum is scraped off by a blade at a cleaning section 202, is overall subjected to corona discharge by a charging electrode 203, whereby the entire surface of the drum is positively charged. Unnecessary parts of the charge on the drum surface charged by electrode 203 are eliminated by an eliminating lamp 204. After that, the charged surface area of drum 201 is exposed to an imagewise light signal, and an electrostatic latent image corresponding to an original document image is then formed on the drum surface. The electrostatic latent image formed on the drum surface is then developed by a toner at the following developing section 205 into a visible image. The toner image on the drum surface is transferred onto a sheet of recording paper in transfer section 206, and the recording paper in close contact with drum 201 is then separated. The separated recording paper is transported through a transport mechanism 207 to juxtaposed rollers 208 thereby be heated and pressed, whereby the toner on the recording paper is fused, and thus a cycle of copying operation is completed. Further, electronic copying apparatus capable of partially trimming and masking the area of a document image also has lately made its appearance, wherein the term 'trimming' means leaving intact only the inside of a boundary line with the other part being eliminated.

while the term 1 masking' means erasing only the inside of a boundary line with the other part being left intact. FIG. 22 is a drawing showing a conventional example of apparatus of this type. In the drawing, 211 is a glass document plate, 212 is an original document placed on the glass document plate 212, and 213 is an objective boundary line defining an area to be trimmed or masking. 214 is a keyboard comprised of display section 215, ten-key array 216 and function key 217.

Where the objective boundary line 213 is a simple rectangle as shown in the figure, if the positions of two points (e.g., points A and C) on an arbitrary diagonal of the four corners A, B, C and D are known, then an objective boundary line 213 can be specified. The coordinates of point A are now regarded as $(X_1, Y_1)$, and those of point C as $(X_2, Y_2)$. The values of $X_1$, $X_2$, $Y_1$ and $Y_2$ are read from the graduations on X and Y axes.

The operator revises the trimming or masking mode by using function key 217, and after that first makes an input of coordinate data of $X_1$ (e.g., 20, 5 as shown in the drawing) by the ten-key array in accordance with the indication of display section 215, and then takes them into the internal control circuit (not shown) by function key 217. Subsequently, the operator feeds in the coordinate data of $X_2$ in the same way. After completion of the input of the positional coordinate data on the X axis, the operator feeds in the positional coordinate data $Y_1$, $Y_2$ on the Y axis in the same way. When a document image is copied after an objective area is thus specified, a trimmed image as shown in FIG. 23(*a*) or a masking image as shown in (b) can be obtained. An attempt has lately been made to utilize electronic copying apparatus of this type to compose a trimmed image and a masking image into one copy image. Such an image composition is effective in obtaining a multicolor composite image as shown in FIG. 24 by composing, for example, a trimmed image 221 as shown in FIG. 23(*a*) and a masking image 222 as shown in (b), which images are differentiated in color (e.g., image 221 is colored red and image 222 blue).

In the case of such an image composition, even how accurately the trimming area and the masking area are specified and even if the positive or negative charge on the uniformly charged drum surface is eliminated by being exposed to light, two different images are seldom composed in a proper position as is shown in FIG. 24 by reason of the irradiation caused by the width of the light beam, the timing delay of the electronic circuit inside electronic copying apparatus, or the dislocation of an original document the copying operation, and therefore in most cases there occurs an overlap as shown in FIG. 25. Namely, an overlappedly printed portion 223 as in the drawing appears to degrade the quality of a copy image.

Additional information recorder-equipped electronic copying apparatus of this type is so designed as to quickly feed a sheet of copying paper to copy the image of additional information display section 231 such as of a date in the leading end (heading) area of the paper before copying the text image of document information. In this instance, the liquid crystal display section for additional information is usually provided underneath the document glass plate's scale plate, but because the reflectivities of the liquid crystal display plane and the reverse of the scale plate usually differ, if copying is made without taking a proper measure such as eliminating the charge in the non-additional information display area 233 by means of charge eliminating section 204 (see FIG. 22), a fog is produced between the additional information display section area and the other area, thus degrading the copy image quality. In the case where an additional information such as a date by autodating system is recorded using the indication of the additional information display section provided to the glass document plate, the copy image quality can be improved by eliminating by means of charge eliminator 204 the periphery of the display image area of the display section, while in the case of magnification-variable copying such as enlargement/reduction copying, the display image area also varies according to variation of the magnification. Accordingly, if the charge eliminating area is invariable when varying the magnification, there occurs an unfavorable phenomenon such as the appearance of an undesirable pattern at the periphery of the display area (in reduction copying) or partial missing in the display image by being partially eliminated by the charge eliminator (in enlargement copying).

OBJECTS AND SUMMARY OF THE INVENTION

The present invention has been made in view of the above circumstances.

It is therefore an object of the present invention to provide an electronic copying apparatus as an image recorder which comprises an image composing device for composing a trimmed image and a masking image into a composite image and an additional data recording device for recording an additional data such as a date by an autodating system, and which is capable of producing an enlarged or reduced-size copy image comprising a composite image with no overlap between the trimmed and masking portions thereof and having no fog between the additional information image area and the other area, and which by no means degrade the quality of the copy image even when an enlargement/reduction copying operation is carried out.

It is another object of the present invention to provide an image recording apparatus which is capable of reproducing an additional information such as a date well-balanced with the text of document information without producing an overlap between them or without causing partial missing in the document information.

The present invention, intended for solving the above problems, provides a copying apparatus which is such that first image data such as, e.g., a first original document, is placed on the document glass plate and positional coordinate data for designating a trimming area is fed in from the keyboard, and subsequently second image data such as, e.g.. a second original document is placed on the document glass plate and positional coordinate data for designating a masking area is fed in from the keyboard, thus specifying the objective boundary line for defining trimming and masking image areas for making a composite image; and which is characterized by having means which, in obtaining a composite image consisting of the first and second document images, provides a slight blank space between the trimming area and the masking area. Further, the present invention also provides an image recording apparatus such as a composite image-reproducible electronic copying apparatus capable of reproducing by composing a plurality of partial images onto a single sheet of copying paper by feeding in image data a plural number of times and comprising a light-emission element array for partially eliminating the charge for the purpose of partial image reproductions, the said light-emission array being arranged spaced 1 to 5 mm apart from the photoreceptor drum.

That is, the present invention is such that image data such as, e.g., a first, document, is placed on the document glass plate and positional coordinate data for defining a trimming area is fed in from the keyboard, and a second document is subsequently placed on the document glass plate and positional coordinate data for defining a masking area is fed in from the keyboard to thus specify objective boundaries for defining both trimming and masking areas, and after that, in obtaining a first-and-second-document composite image, the overlap portion produced between the trimming area is dissolved by the light-emission element array for partially eliminating the charge, which is arranged spaced 1 to 5 mm from the photoreceptor drum. Also, the present invention is such that, in an additional information recorder-provided electronic copying apparatus which is so constructed that an additional information can be copied in addition to a document image, the said image recording apparatus comprises a charge eliminating lamp for eliminating the charge in the area on an image carrier such as the photoreceptor drum corresponding to the non-additional information area on a sheet of copying paper.

Further, the present invention comprises an image recording apparatus such as an electronic copying apparatus having on the reverse of the document glass plate's scale plate thereof an automatic date display section that can be copied along with a document information image, and so constructed that the charge eliminating area on an image carrier such as the photoreceptor drum can be varied according to the magnification set by the keyboard operation.

Furthermore, the present invention is such that, in an image recording apparatus capable of copying an additional information along with a document information image, the said apparatus is so constructed that a reduction copying is made at the time of recording the additional information, and the rate of the reduction can be varied according to the size of copying paper.

BRIEF DESCRIPTION OF THE DRAWINGS

FIG. 1-*a* is a drawing showing the mechanical construction of an example of this invention.

FIG. 1-*b* is a cross-sectional view of the scale and the periphery thereof in FIG. 1-*a* (the direction of the cross section is in parallel with the plane of the drawing of FIG. 1-*a*).

FIG. 1-*c* is a plan view of the peripheral section of the scale plate in FIG. 1-*a*.

FIG. 1-*d* is an explanatory drawing of the display module in FIG. 1-*a*.

FIG. 1-*e* is an explanatory drawing of the apparatus of FIG. 1-*a*.

FIG. 20 is an explanatory drawing of copying examples by the apparatus of this invention.

FIG. 21 is a schematic drawing showing the construction of a conventional image recording apparatus.

DESCRIPTION OF THE PREFERRED EMBODIMENT

Figure 2:
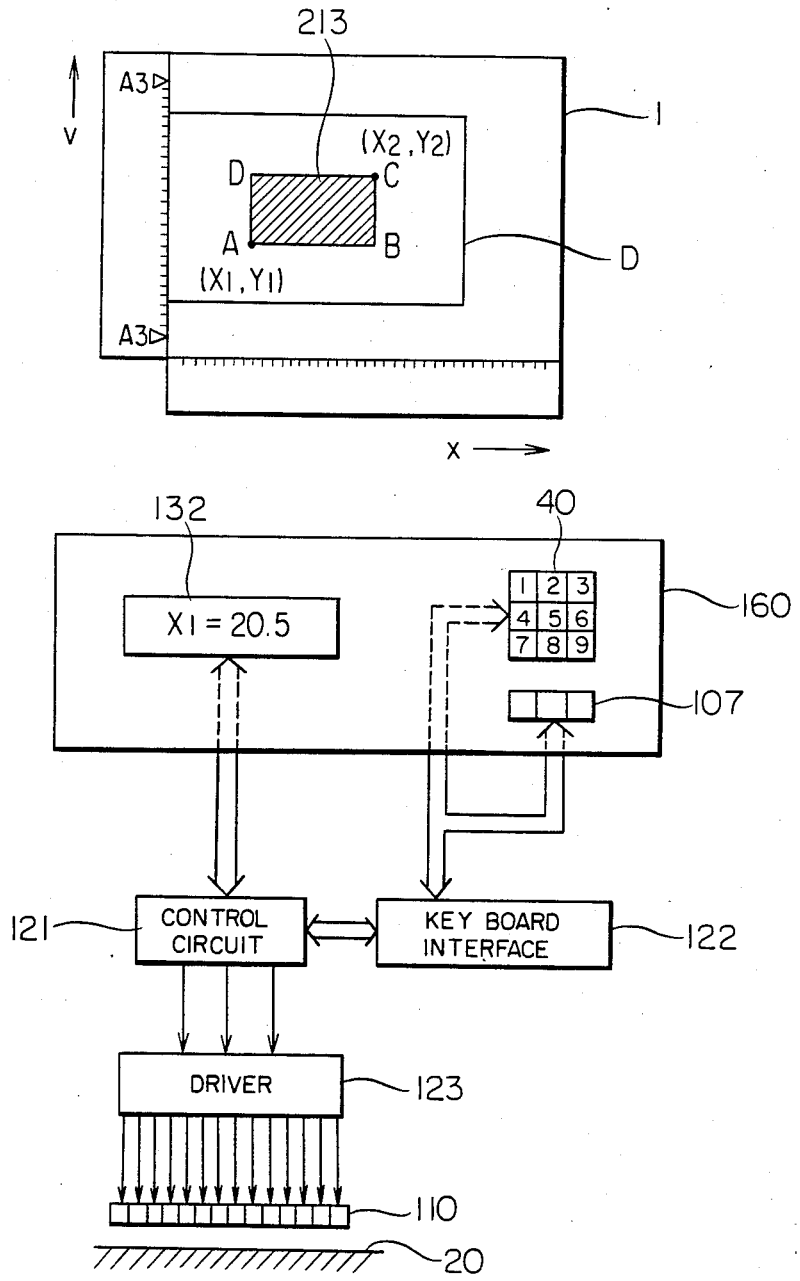
FIG. 2 is a drawing showing an example of the image composing device.

The present invention will be illustrated in detail by the drawings. FIGS. 1-*a*, 1-*b*, 1-*c*, 1-*d* and 1-*e* are drawings showing the mechanical construction of an example of the electrophotographic copying apparatus of this invention. As is shown in FIG. 1-*a*, on the top center of the copying apparatus body is arranged a document glass plate 1 made of transparent glass, on which an original document D is to be placed. and at the left end of document glass plate 1 is provided a scale plate 2 for designating the position of document D according to the size thereof, and, further, on the document glass plate 1 is provided a document cover 3 so as to be fallable toward an operator. Document D is placed on document glass plate 1 with its position adjusted to the designated scale of scale plate 2, and its position is fixed by being covered with document cover 3. In the proximity of the middle of the underneath of scale plate 2, a display module is arranged with its display portion 4*a* facing downward. In this example, display portion 4*a* is of reflection-type 7-segment liquid crystal elements capable of displaying a date or a number. The mounting of display module 4 is described in detail: For example. as is shown in FIGS. 1–6, display module 4 is arranged with its obverse side facing opposite to the part of plate 5 sloping upward by 10 to 20 degrees against the horizontal, and the display module 4 is held down from its back toward the plate 5 side by a substrate hold-down 7 against the elasticity of the cushions placed between the marginal portions of display module 4 and the plate 5, and the plate 5 is fixed through a glass stopper plate 8 to the body's panel.

Underneath the document glass plate 1 and inside the copying apparatus body a first mirror unit 12 having an exposure lamp 10 and a first mirror 11 is provided linearly movably in parallel with the document glass plate 1 and in lateral directions of FIG. 1-*a* so as to scan the entire surface of document D. A second mirror unit 15 composed integrally of a second mirror 13 and a third mirror 14 is provided linearly movably at a half speed of the first mirror unit 12 so as to retain a specified length of the optical path in parallel with the document glass plate 1 and in lateral directions of FIG. 1-*a*. A principal lens 16 is a lens upon which the reflected light from the document D on document glass plate 1 is incident after passing through the above-mentioned mirror 11, second mirror 13 and third mirror 14, and the light that has passed through the principal lens 16 advances through a fourth mirror 17 and then through a slit 18 to be incident upon a photoreceptor drum 20.

A charger electrode 21 is an electrode for charging uniformly photoreceptor drum 20. Accordingly, on the photoreceptor drum 20 revolving clockwise is formed in sequence and electrostatic latent image by the incident light from the optical system. A developing device 22 is one for developing the electrostatic latent image on the photoreceptor drum 20 into a visible toner image.

On the other hand, a paper-feed device for feeding sheets of copying paper comprises a paper-feed cassette 23 holding sheets of copying paper P (two cassettes are shown in this example), a first roller 24 for taking out sheets of paper one by one from the paper-feed cassette 23, second paper-feed juxtaposed rollers 25 for feeding the taken-out sheet of copying paper P toward photoreceptor drum 20, and guide plates 26 and 27 arranged between the paper-feed cassette 23 and second paper-feed rollers 25 and between the second feed rollers 25 and a transfer electrode that will be described hereinafter, respectively. At the time of copying operation, a sheet of paper is taken by first feed roller 24 out of a selected paperfeed cassette 23, and then guided by guide plates 26 to reach second feed rollers 25, which are driven by a paper-feed timing signal so as to render the leading end of copying paper P to coincide with the leading end of the toner image on photoreceptor drum 20. A transfer electrode 28 is an electrode to transfer the toner image on photoreceptor drum 20 onto a sheet of copying paper P. A separation electrode 29 is an electrode to separate the copying paper P from the photoreceptor drum 20. The separated paper P is then transported by paper transport means 30 to a fixing device 31 to be fusedly fixed by a thermally fixing roller and a pressure roller and then ejected onto a copy paper receiving tray 33. After completion of the transfer process, the photoreceptor drum 20 is cleared of the residual toner remaining thereon by a cleaning device 34. In order to facilicate the removal of the residual toner, a cleaning neutralizer electrode 35 as an AC corona discharger is provided prior to the cleaning device. Behind charging electrode 21 a charge eliminator 36 for eliminating by light the charge in the non-image area to keep the non-image area from toner attaching thereto is arranged so as to face photoreceptor drum 20. In addition, 37 and 38 are pre-charging exposure section and pre-transfer exposure section, respectively.

FIG. 1-*e* is a drawing showing the principal part of the control panel in the above example. The control panel is provided in the upper foreground of the copying apparatus body. In this drawing, 40 is a ten-key array for setting a desired number of copies and the set number is displayed on LED 41. 42 is a button (hereinafter called P-button) for use in producing thick-paper fixing, interruption copying, and other functions. 43 is a STOP/CLEAR button. 44 is a COPY button. 45 is an AUTOMODE button for use in actuating a mechanism (APS) for detecting the size of a document and automatically judging what size copying paper should be fed. 46 is a CASSETTE SELECTION button. 47 is a MAGNIFICATION CHANGE button. 48 are ZOOM buttons. 52 is a magnification display LED. ZOOM buttons 48 are for changing the magnification by given stages in the zoom mode made by MAGNIFICATION CHANGE button 47, in which 48*a* is an ENLARGEMENT button, while 48*b* is a REDUCTION button. 49 are DENSITY SELECTION buttons consisting of DENSITY-DOWN button 49*a* and DENSITY-UP button 49*b*, and a selected density is displayed as one of the seven stage/levels on density display LED 50.

Further, 51 is a MODE SELECTION button for use in recording an additional information. or the like, and enables to select any one of (1) date recording mode as for an additional information, (2) number recording mode as for an additional information, and (3) non-recording mode. By depressing MODE SELECTION button 51 sequentially, cyclic mode selection as mode (1) to mode (2) to mode (3) to mode (1) . . . can be carried out. When mode (1) is selected, LED 51*a* lights, when mode (2) is selected, LED 51*b* lights, and when mode (3) is selected. neither LED 51*a* nor LED 51*b* lights.

The display content of display module 4 in the date recording mode is a display of year, month and day (e.g., 1984.12.31 as shown in FIG. 1-*d* for Dec. 31, 1984) or a display of time (e.g., 16.40 for 4:40 p.m.). If the display module 4 has a permanent calendar and clock functions, the subsequent setting procedure is not required by once instructing which of the date (year, month and day) and time should be displayed and by setting the moment time by using keys 4*b* through 4*e*.

On the other hand, the display content of the number recording mode is a number of up to, e.g., six figures. When this mode is set, 'A' through 'F' representing the sixth figure to first figure of a number desired to be fed in the tenth digit of a number of two figures displayed on display LED 41 for displaying a set number of copies is displayed in sequence. and while the 'A' through 'F' each is sequentially on display, ten-key array is used to feed in a desired number for each figure (if some figure(s) should be blank, STOP/CLEAR button 43 is to be depressed ON), and finally when P-button 42 is depressed ON, the set number of figures is read by the microcomputer inside the copying apparatus body (hereinafter described), from which the number to be displayed is sent to the display module 4.

FIG. 2 is a drawing showing the construction of an example of this invention. In the drawing, 121 is a control circuit for performing various operation controls. 122 is a keyboard interface for receiving operation signals from ten-key array 40 and function keys (buttons 42 through 51 except 44 are generically called 'function keys') to convert them into digital data corresponding to the appropriate contacts. As the control circuit 121, e.g., a microcomputer is used, and as the keyboard interface 122, e.g., a microcomputer or digital circuit is used.

Figure 22:
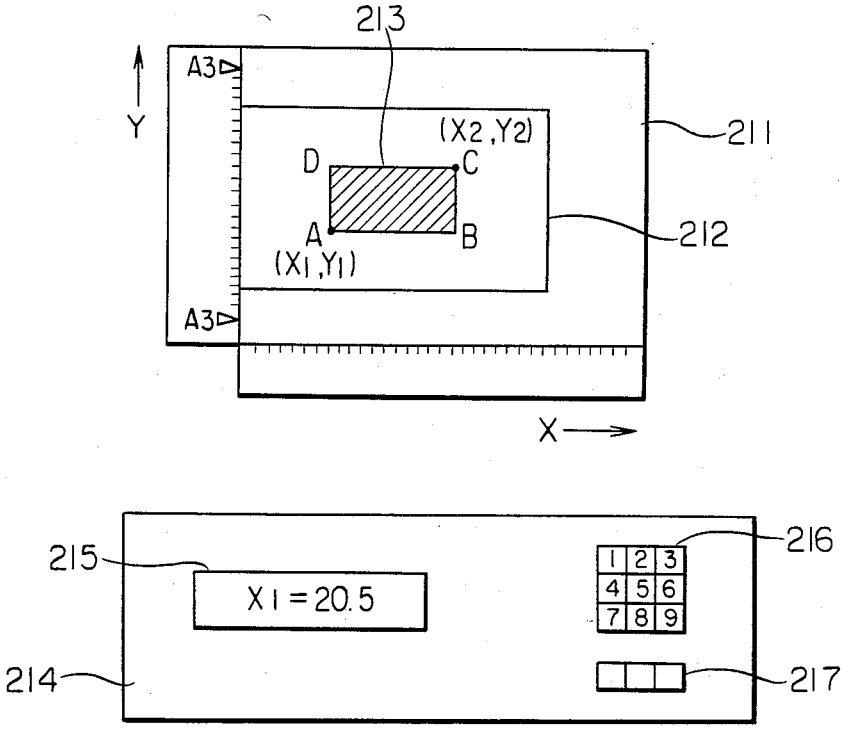
FIG. 22 is a drawing showing an example of conventional apparatus.

LED array 110 is connected through driver 123 to control circuit 121, and faces opposite to the foregoing photoreceptor drum 20. The control circuit 121 and driver 123 are connected by three signal lines: data line, strobe line. and clock line. The LED array 110, in this example. is comprised of 52-segment LED elements arranged in a row, and the driver 123 and LED element array 110 are connected by the number of lines corresponding to the number of LED elements, and the driver 123 according to the number instructed by the data signal from control circuit 121 is turned ON. And the driver 123 is latched by a strobe signal, and the LED element according to the instructed number is turned ON. And elimination of the charge on photoreceptor drum 20 is made for the purpose of partial reproduction. The thus constructed apparatus will be further illustrated with respect to the operation thereof:

An operator first places a first original document on document glass plate 1 and uses function keys 107 to set the trimming mode, and then feeds in positional coordinate data ($X_1$, $Y_1$) and ($X_2$, $Y_2$) for defining an objective boundary 213 in the same manner as described earlier in FIG. 22. After completion of the input of the positional coordinate data for defining objective boundary 213, the operator uses function keys 107 to tell the control circuit 121 of the completion of the input operation.

Figure 23:
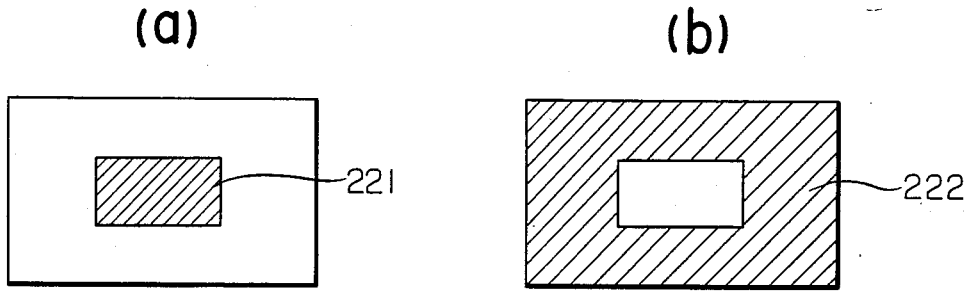
FIG. 23 is a drawing showing copy image examples.
Figure 24:
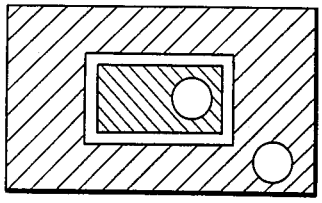
FIG. 24 is a drawing showing a composite image example.
Figure 25:
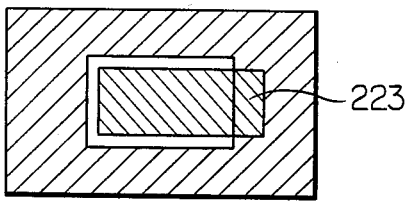
FIG. 25 is an explanatory drawing of an overlapped portion.

Subsequently. the operator places a second original document on document glass plate 1 and uses function keys 107 to set the masking mode. and then feeds in positional coordinate data for defining a masking area in the same way as has been made in the trimming mode. Supposing a masking area as shown in FIG. 23(*b*) is defined, also in this instance, the coordinate points A and C may be used for defining the area. After completion of the data input. the operator uses function keys 107 to tell the control circuit 121 of the completion of the data input operation.

After completion of the above input procedure, these two images are then composed into a composite image. To be concrete, the trimmed image of the first document is printed on a sheet of recording paper, and after that the same sheet of recording paper is again set in the copying apparatus, and the masking image is superposedly printed on the same paper. Control circuit 121, when copying the masking image, sends a control signal to charge eliminator section 36 to somewhat widen the exposure width W for eliminating the charge. As a result, even if the trimming area is slightly shifted due to the dislocation of the document or timing delay, no overlap with the masking image occurs, thus enabling to produce a proper composite image.

In order to meet such operations, a memory is built in control circuit 121. The input data by defining the trimming area and feeding in the trimming data, the input data by defining the masking area and feeding in the masking data . . . a set of such the input data by a plurality of trimming and masking data feeding procedures are stored in the memory inside control circuit 121. And the above input data in the set, each time when depressing the COPY button, are to be used one by one.

Subsequently. the charge eliminator section 36's exposure width changeable operation will be illustrated in detail.

Figure 4:
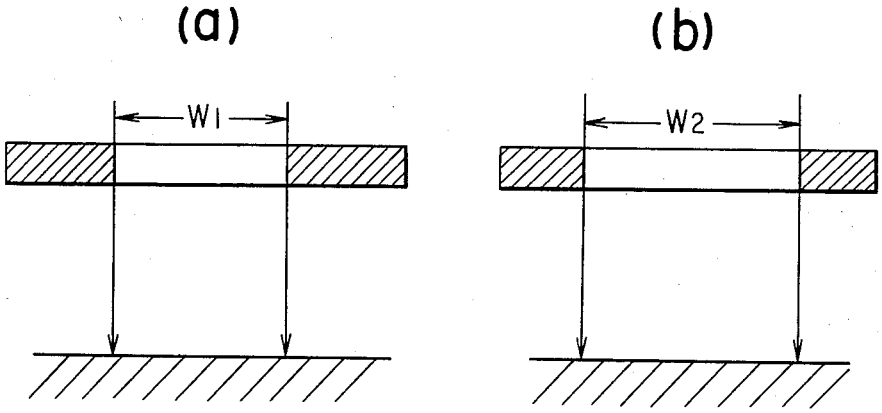
FIG. 4 is a drawing showing the charge eliminating section in the state of making exposure.

Charge eliminator section 36 is comprised of a plurality of LED elements as mentioned earlier, and receives driving signals for the respective LED elements from control circuit 121 to vary the exposure width or extent. For example, if the exposure extent for the masking area at the time of no correction is $W_1$ as shown in FIG. 4(*a*), the exposure extent for the masking area at the time of making a composite copy image is $W_2$ as shown in (b) of the same figure to become wider. In the drawing the oblique-lined portions show the non-lighting area.

Figure 5:
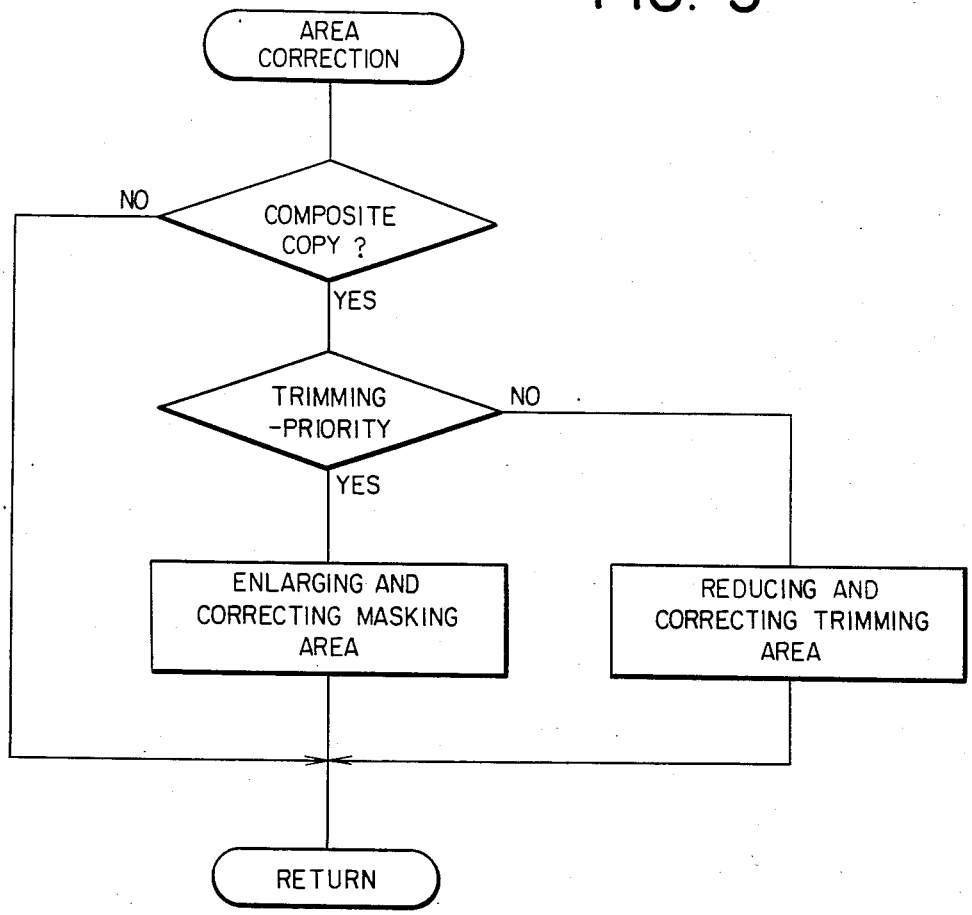
FIG. 5 is a drawing showing the sequence of the copying process by the apparatus of this invention.

Thus, according to this invention, since the lighting extent of charge eliminator section 36 is changeable at the time of composing the trimmed image and masking image into a composite image, the charge eliminating extent on photoreceptor drum 20 can be correctly determined. Accordingly, an overlap-free high-quality composite copy image can be obtained. In addition, a light, in its nature, when incident upon a point, produces its irradiation around the point. Then, the interval between the LED elements of charge eliminator section 36 and the drum 20 is made as small as possible to lessen the influence of the irradiation (however, the interval should not be less than 1 mm because another unfavorable influence is anticipated if it is). FIG. 5 is a flowchart showing the sequence of the copying process in the copying apparatus of this invention. Firstly, a judgement is made as to whether a composite copying should be made or not, and it is then followed by a judgement of whether priority should be given to trimming. If the trimming is preferential, the masking area should be extended to make a trimmed image copy preferentially, while if the masking is preferential, the trimming area should be reduced to make a masking image copy preferentially.

In the above description, an example where the masking area is extended to make a composite image copy has been explained. Also in the case where, in contrast, the trimming area is reduced to make a composite image copy, a similar effect can be obtained. Further, the above description has been made, taking as an example the construction in which the exposure extent of the charge eliminator section of the drum is somewhat extended as means of providing a blank space between the trimming area and the masking area. However, the present invention is not limited to the above instance but permits the use of any construction as long as it can provide some blank space as described above between the trimming area and the masking area. For example, a construction in which the exposure extent of the light from the charge eliminator section can be enlarged or reduced by use of a mechanical shutter or an optical system may also be used.

Thus, according to this invention, the providing of a blank space between the trimming area and the masking area enables to prevent an overlap in making a composite image copy from a trimmed image and a masking image, thus having a large, favorable effect upon the practical composite image copy making operation.

Figure 3:
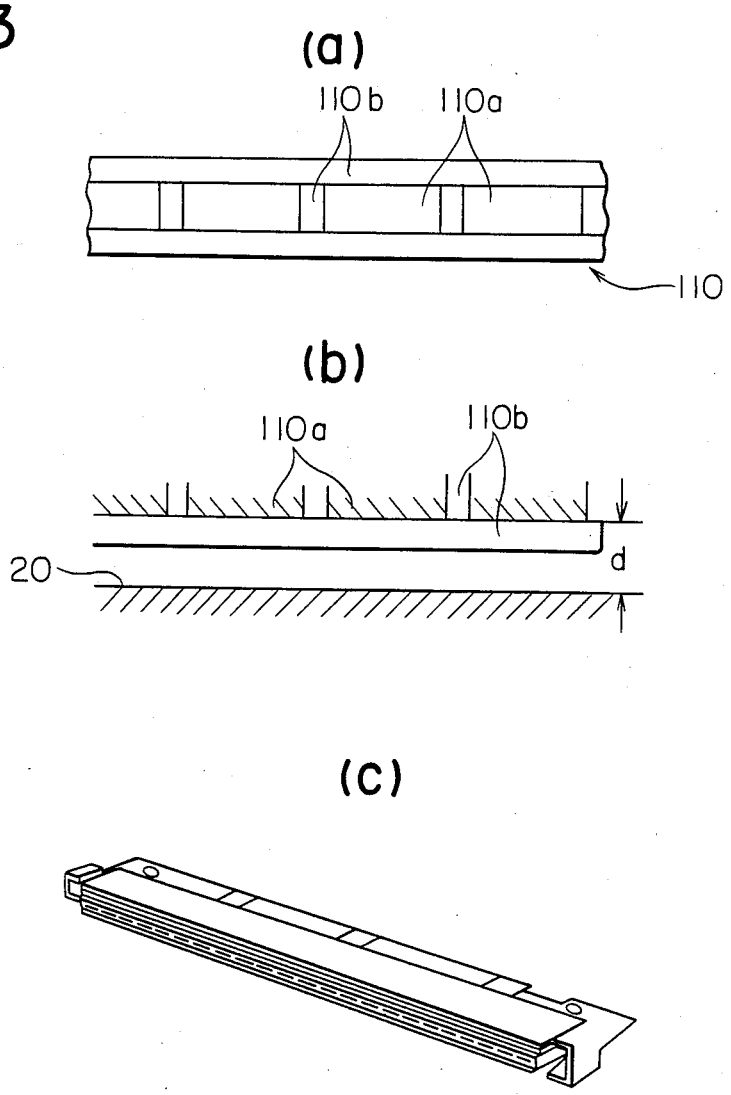
FIG. 3 is a drawing showing an example of the LED array, wherein (a) a front view, (b), is a side cross-sectional view, and (c) is a perspective view.

Hereupon, however, a very slight overlap cannot be avoided which appears around the boundary because of a slight shift of the trimmed image or masking image due to the dislocation of a document or timing delay. In order to eliminate an awkward overlap portion, in the present invention, the LED array's emission plane is arranged to leave a space d from the surface of the photoreceptor drum to thereby render the light-quantity distribution curve of the illuminating light over the boundary area from the illuminated portion through the non-illuminated portion on the surface of the drum have an appropriate inclination. FIG. 3 are enlarged drawings of an example of the LED array used for this purpose, wherein FIG. 3(*a*) is a front view when viewed from the emission plane side. FIG. 3(*b*) is a side cross-sectional view, and FIG. 3(*c*) is a perspective view. As a result of our experiments performed with respect to several LED arrays different in the form including the one shown in the drawings, we have concluded that the space d between the LED array's emission plane and the surface of the drum is required to be from 1 to 5 mm, and preferably from 2 to 4 mm. In addition, the LED array 110 shown in the drawings is one formed by arranging 2 mm×5 mm rectangular LED segments 110*a* in a row with 1 mm-thick support members 110*b* for supporting the LED segments.

Since the LED emits appropriately scattered light by being arranged with the above-mentioned space between its emission plane and the surface of the photoreceptor drum, a proper blank space is formed in the periphery of each of the trimming and masking areas, thus enabling to make an image eliminating area having such a proper extent as forming no image overlap in the boundary in making a composite image copy.

The above space, if more than 5 mm, makes the blank portion formed in the boundary so large as to become conspicuous to be unacceptable for a composite image. And if it is smaller than 1 mm, it causes the appearance of an image overlap in the boundary to be also unacceptable.

Figure 6:
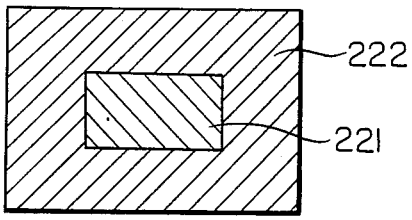
FIG. 6 through 9 are explanatory drawings of overlap examples.
Figure 7:
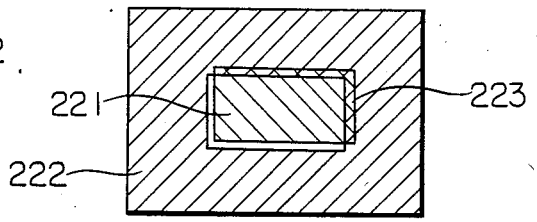
Figure 8:
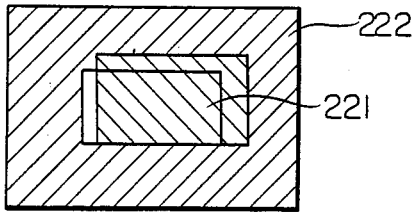
Figure 9:
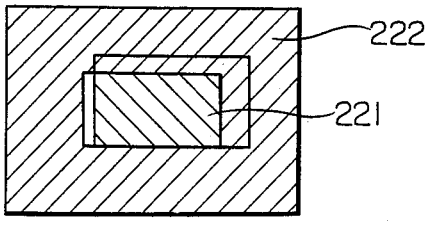

The present invention is effective in the case where the trimmed image 221 as shown in FIG. 23(*a*) and the masking image 222 as shown in FIG. 23(*b*) should be composed with the same boundary into the composite image as shown in FIG. 6 but in fact shifted slightly to be composed into the composite image as shown in FIG. 7, and it is not effective in the case where both images 221 and 222 are composed with a considerably overlapped area. In this instance, it is desirable to incorporate a trimming-preferential or masking-preferential selection program as shown in FIG. 8 and FIG. 9, which, for the overlapped portion, performs the elimination of the masking area's overlapped portion or the trimming area's overlapped portion, and by the incorporation of such a selection program, the present invention can be remarkably effective.

The present invention is not limited to the above-described example, and permits the use of such charge eliminating means comprised in combination of LED elements and liquid crystal. For example, a composite image copying in the manner that, in making a composited image, priority is given to the desired one of both images overlapping each other with respect to the overlapped portion by preferential selection of the one to remain with the other overlapped part not selected being eliminated may also be effective.

Subsequently, the additional information recording device incorporated in the image recording apparatus of this invention will now be illustrated.

Figure 10:
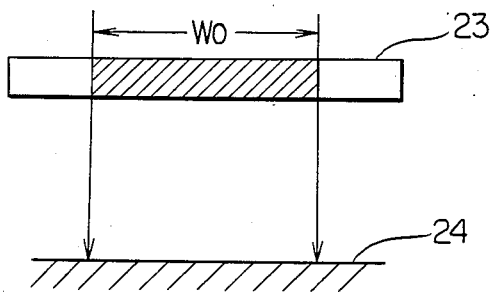
FIG. 10 is a drawing showing the photoreceptor drum in the state of being exposed to the charge eliminating lamp light.

When the COPY START button (not shown) is depressed, the electronic copying apparatus starts its copying operation: That is, photoreceptor drum 20 begins its revolution, and its entire surface is charged by charging electrode 21. In this state, control circuit 121 sends an exposure control signal to driver 123. As a result, driver 123 drives charge eliminator lamp 110, and the lamp 110 makes an exposure of the surface of photoreceptor drum 20 as is shown in FIG. 10. In FIG. 10, the oblique-lined portion of charge eliminator lamp 110 is a nonlighting area, and the width Wo of this nonlighting area corresponds to the width Wo of liquid crystal additional information display section 231 (see FIG. 26). Namely, by performing an exposure control as shown in FIG. 10, the charge in the area other than the additional information display portion 231 on the drum surface can be eliminated.

Figure 26:
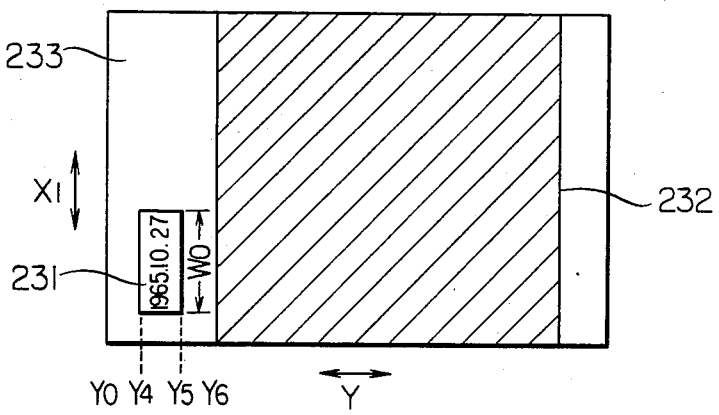
FIG. 26 is a drawing showing a copy image example.

The above description is for the exposure control made along X axis in FIG. 26, but the same exposure control can be applied to Y axis. Since the range of $Y_0$ to $Y_4$ is not of the additional information display section, the $Y_0$–$Y_4$ range is required to be all cleared of the charge by lighting it with charge eliminator lamps 110. For the $Y_4$–$Y_5$ range, the exposure control described in FIG. 3 is performed. And for the $Y_5$–$Y_5$ range, because its situation is the same as that of the $Y_0$–$Y_4$ range, the charge in the range is all eliminated.

Thus, in order that the exposure control can be made according to the range, the copying paper (recording paper) size (such as $A_4$, $A_5$, etc.) and the dimensions of additional information display section 231 are required to be previously known. Then these dimensional data are to be in advance stored in a nonvolatile memory built in control circuit 121 before shipping. Thereafter, the control circuit takes appropriate data out of the built-in nonvolatile memory each time a copying operation is made, and calculates the positions and the number of charge eliminator lamps 110 to light, and sends an exposure control signal to driver 123.

In the above, an example where LED elements are used as the charge eliminator lamps has been described, but this invention is not limited to the example: For example, an assemblage of small incandescent lamps may also be used in place.

As has been described, according to this invention, in an additional information recorder-provided electronic copying apparatus, by eliminating the charge in the non-image area other than the additional information display section by means of charge eliminator lamps, a fog-free, high-quality image can be obtained.

Figure 11:
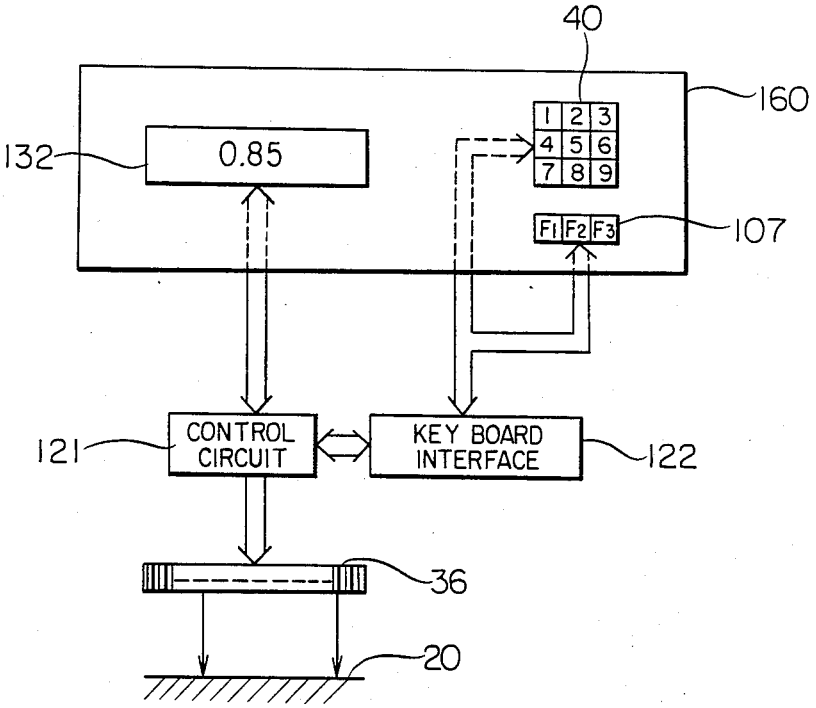
FIG. 11 is a drawing showing the construction of an example of this invention.

Another example of the additional information recording and composite image copying in this invention will now be illustrated:

FIG. 11 is a drawing showing the construction of the example, wherein 160 is a keyboard operation section which is comprised of a display section 132, ten-key array 40, and function keys 107. In the drawing, 121 is a control circuit performing various operation controls, and 122 is a keyboard interface which receives operation signals from ten-key array 40 and function keys 107 to convert them into digital data corresponding to the respective contacts and give the data to control circuit 121. As the control circuit 121, for example. a microcomputer is used, and as the keyboard interface 122, e.g., a microcomputer or a digital circuit is used. 36 is a charge eliminator section driven by a signal from control circuit 121, and 20 is a photoreceptor drum which is exposed to the light from the charge eliminator section 36. Display section 132 and control circuit 121 are connected by a digital bus. As the charge eliminator section 36, neutralizer lamps such as, e.g., LED elements are used.

The operation of the thus constructed apparatus is as follows:

Firstly, an operator uses function keys 107 to set the magnification change setting mode, and then uses ten-key array 40 to feed in a magnification. The contact signal from the ten-key array is converted by keyboard interface 122 into a code signal (such as AS II code) to be sent to control circuit 121. Control circuit 121 judges the input signal and sends it to display section 132 to have it display the signal. As a result, on the section 132 is displayed, for example, the reduction rate '0.85'as shown in the drawing. This value is simultaneously stored in a memory (e.g., RAM) inside the control circuit 121.

Control circuit 121 calculates the area of date display section 231 according to the magnification 0.85. After completion of the calculation of the area of date display section 231, and the non-image area 233 is then the area whose charge is to be eliminated. Control circuit 121 sends a driving signal to charge eliminator section 36 to have the section change the exposure width on the surface of drum 20.

Figure 12:
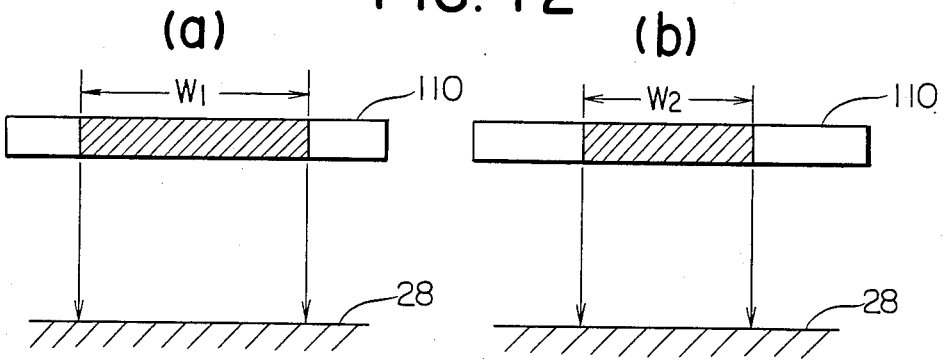
FIG. 12 is a drawing showing a change in the width of exposure.

FIG. 12 are drawings showing a change in the exposure width of the neutralizer lamps 110 of charge eliminator section 36, wherein (a) shows the exposure state at the time of equal magnification, and (b) shows the exposure state at the time of a reduction magnification (such as 0.85). In the drawings, the oblique-lined portions are the non-lighting area..

If the non-lighting area's width (the width corresponds to that of date display section 231) at the time of equal magnification copying is regarded as $W_1$ as shown in (a), the non-lighting area's width at the time of reduction copying becomes $W_2$ as shown in (b), thus being narrower than the width in (a). Therefore, the charge area's width on drum 20 is $W_2$, and the other area's charge is eliminated.

Figure 13:
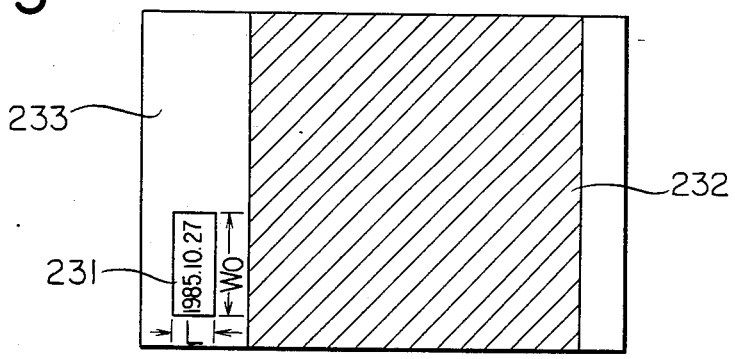
FIG. 13 is a drawing showing a copy image example.

The $W_1$ and $W_2$ each corresponds to a width slightly wider than the width Wo of data display section 231 in FIG. 13. In addition, when changing the magnification, the length L of the display section changes also in the longitudinal direction of a document. Therefore, the non-lighting area's extent of charge eliminator section 36 is changed also in the longitudinal direction of the document. This is carried out by changing the timing of the lighting/non-lighting signal from control circuit 121 according to the change of magnification.

When photoreceptor drum 20 comes to the document area 232 shown in FIG. 13, the exposure width of charge eliminator section 36 changes (the non-lighting area of FIG. 12 is largely extended) due to the control operation of control circuit 121, and the charge in the non-image area alone is eliminated. Thus, the charge elimination in the data-indicated section and document image area at the time of reduction copying is properly carried out, and, as a result, a high-quality copy image with its data indication free of fog can be otained.

In the above an example of reduction copying has been described. The same way can be applied also to enlargement copying. In this instance, the non-lighting area's width of charge eliminator section 36 differs from that in FIG. 12, and is widened at the time of enlargement copying.

Also the above description has been made taking as an example the case where, as means to vary the charge eliminating extent on the photoreceptor drum, the charge eliminator sections's neutralizer lamps are so constructed that its exposure extent is variable. However, the present invention is not limited to this. The charge eliminator section may also be so constructed that the charge eliminating extent can be varied by use of a mechanical shutter or optical lens, or the like.

As has been described above, according to this invention, by varying the charge eliminating extent of the date display section according to the change in magnification of the image recording apparatus such as auto-dating function-provided electronic copying apparatus, a copy image with a date indication free of fog at the time of enlargement/reduction copying can be obtained.

Figure 15:
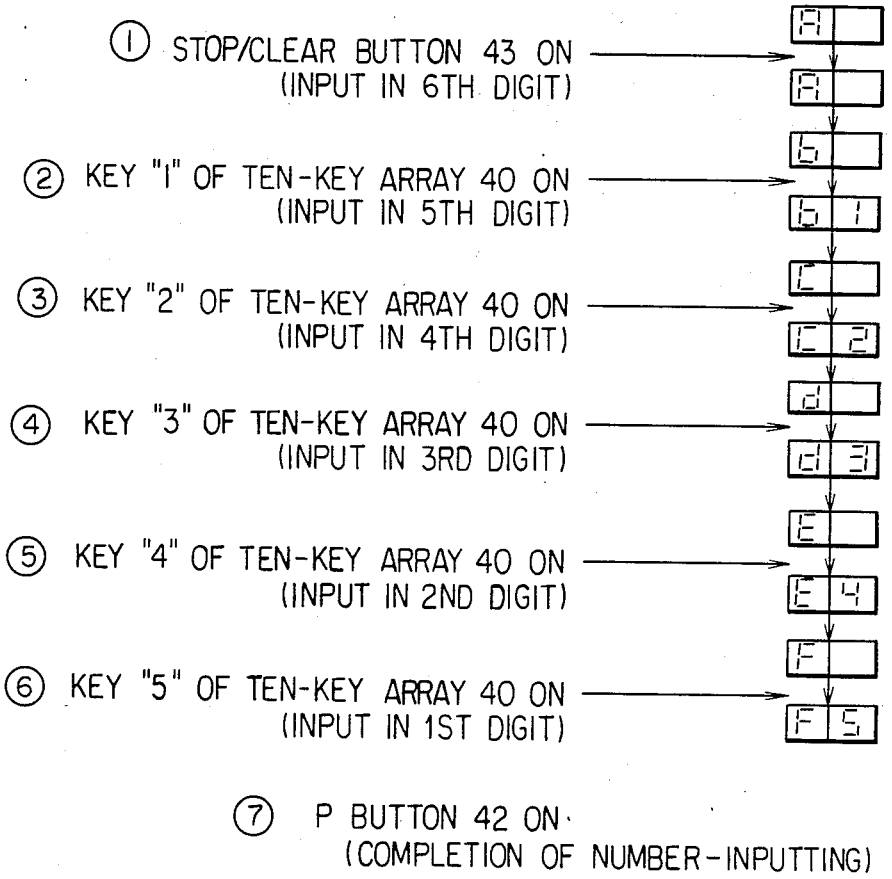
FIG. 15 is an explanatory drawing of the number setting procedure in the number recording mode.

Still another example of the additional information recording with composite image copying of this invention will be illustrated:

An example of setting a number '12345' (sixth figure from the unit digit is blanked) is shown in FIG. 15. In this example, LED 41 is so designed as to be on standby after an input value is displayed in its unit-digit position in a short period.

Figure 16:
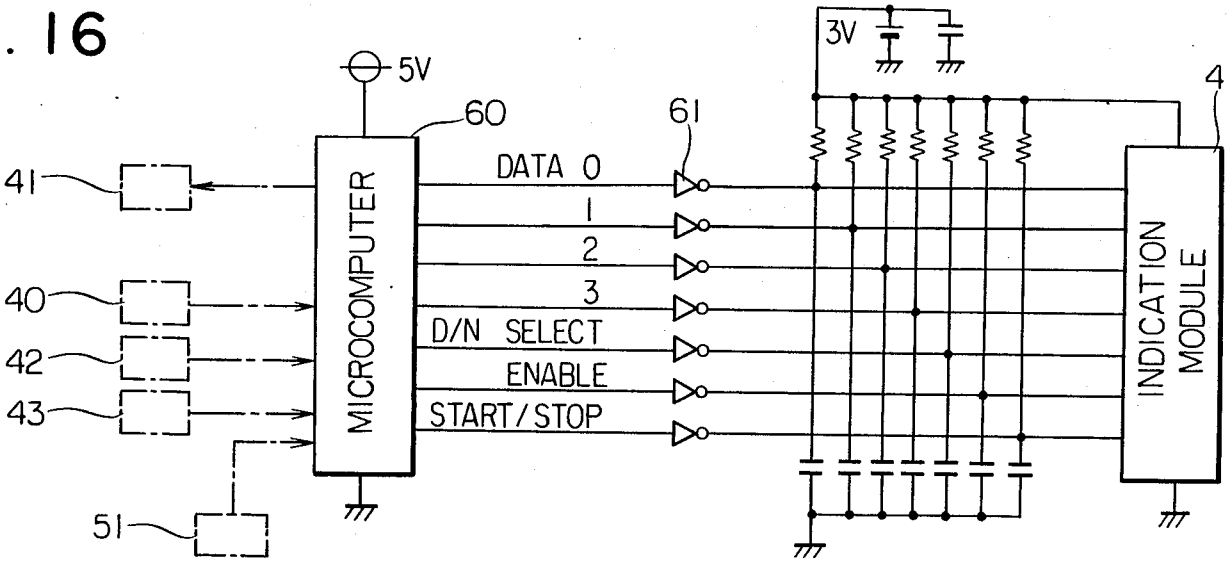
FIG. 16 is an explanatory drawing of the construction of the set data transfer system.
Figure 17:
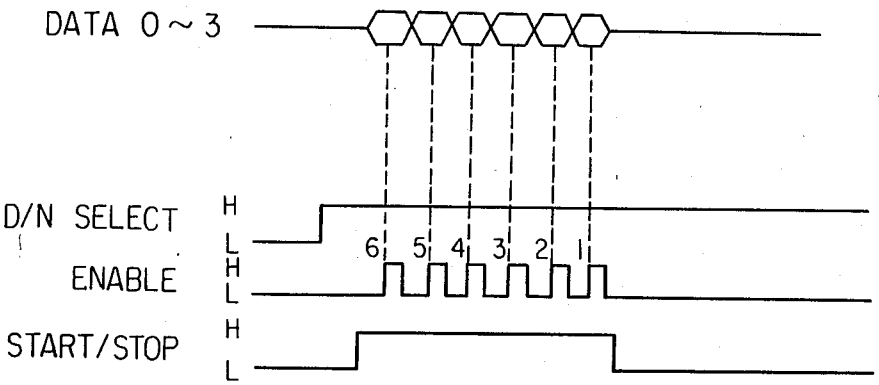
FIGS. 17 and 18 are drawings showing numerical data transfer time charts.
Figure 18:
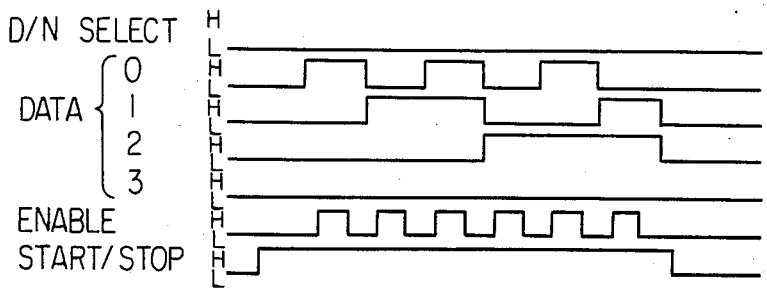

FIG. 16 shows a construction in which control microcomputer 60 inside the copying apparatus body transfers a data through buffer 61 to display module 4. In this construction, for the transfer of the data an eight-bit signal line is used, and because the data itself is expressed by BCD code, four bits (DATA 0-3) are assigned to it (for the blank, four bits are all on H level), and one bit each is assigned to the signal D/N SELECT which shows either date data D(L) or number data N(H) (if display module 4 has no clock function, microcomputer 60 needs to obtain date data from the clock module, etc., and send it to display module 4. Assuming this, a construction using the D/N SELECT signal capable also of transferring date data is shown), the signal ENABLE for taking the leading data (DATA 0-3) into display module 4, and the signal START/STOP for indicating the data send-out period with H level. FIG. 17 shows a time chart for the transfer of number data N, and FIG. 18 shows the time chart for the transfer of an actual number '123456.'

Figure 19:
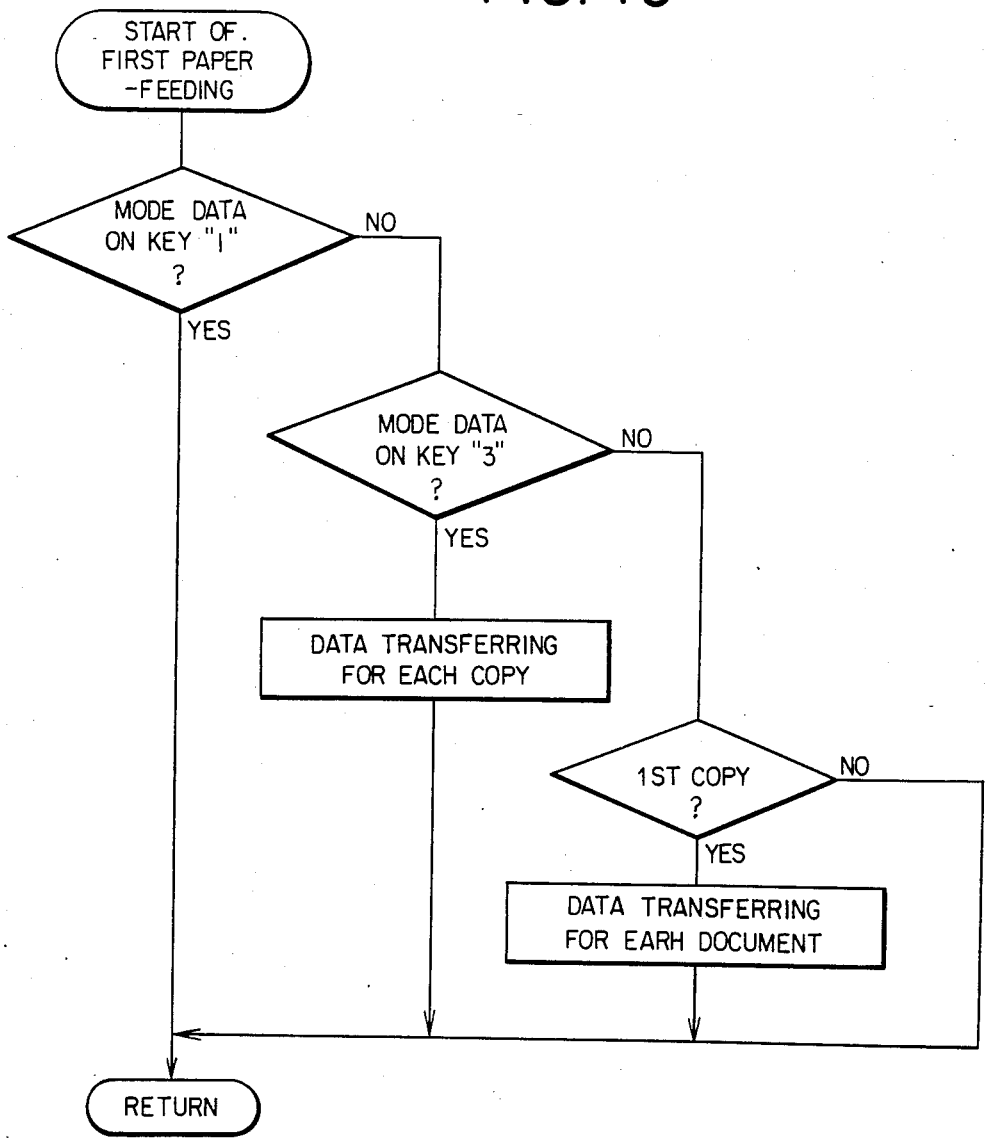
FIG. 19 is a flowchart showing the routine of increasing or decreasing the number.

Further, the apparatus is so constructed that increment of the number displayed on display module 4 is made automatically each time when making one copy by depressing the principal switch (not shown) ON with the STOP/CLEAR button 43 and the '3' key of ten-key array 40 on the control panel depressed simultaneously, and decrement of the number displayed on display module 4 may be made for each document copy by depressing the principal switch ON with the STOP/-CLEAR button 43 and the '2' key of ten-key array 40 (replacement of documents are detected, e.g., upon completion of making a given number of copies), and fixing (lock) of the number on display module 4 may be made by depressing the STOP/CLEAR button 43 and the '1' key of ten-key array 40 depressed simultaneously. To be concrete, microcomputer 60 writes in the appropriate area of the nonvolatile memory inside the copying apparatus body the mode data indicating which of the keys '1', '2' and '3' has been depressed during the above operation, and thereafter reads the mode data each time when a paper feed is made by first feed roller 24, and, on the basis of the data, sends a new necessary data to display module 4 to thereby make increment/decrement of the number. FIG. 19 shows the routine flowchart for these operations.

Also, this apparatus is so constructed that, when either one of the foregoing data recording mode and number recording mode is selected, such an additional information is reproduced along with document information. Namely, the start timing of second feed rollers 25 is in advance of that of conventional apparatus so as to make the leading end of the toner image including the additional information image (on photoreceptor drum 20) coincident with the leading end of copying paper P. Further, in the case where an original document sheet is almost full of its text, if the start timing of second feed rollers 25 is advanced, the trailing end of the document text becomes out of being copied, so that, in such the recording mode, a reduction copying is carried out.

Figure 14:
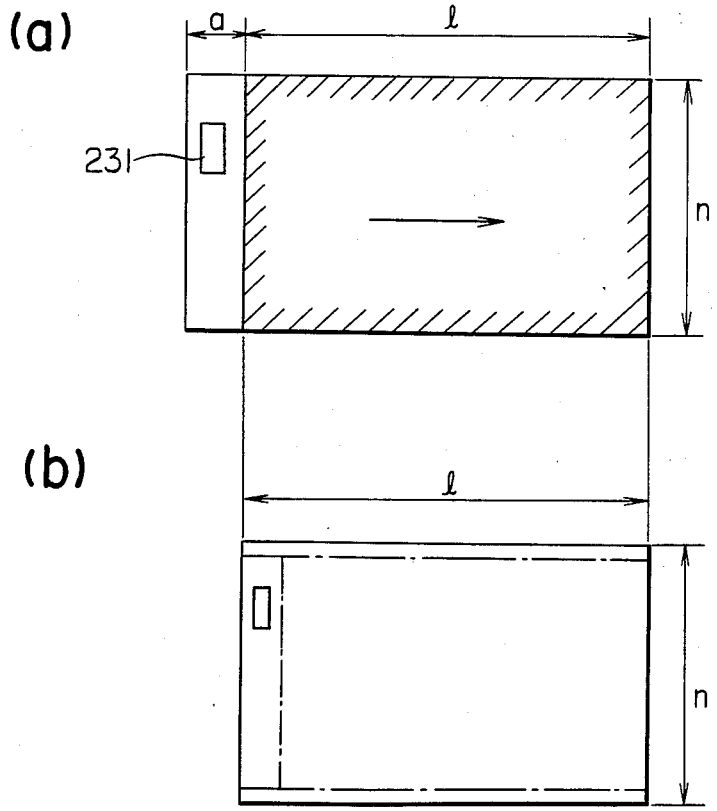
FIG. 14 is an explanatory drawing of the magnification used in the reduction copying.

Hereupon, as is shown in FIG. 14(*a*), if the length (standardized length) of a document in the optical scanning (exposure) direction (of the arrow) is regarded as l, and the length to be secured for the recording of an additional information is regarded as a, then the suitable magnification m for reduction copying is:

$$m = l/(l+a)$$

(FIG. 14(*b*) shows the case where (a) is reduced by the magnification m). Then, this magnification, assuming the case of a=about 20 mm, establishes the following magnifications: (1) m=0.94 where A3 or B4-size recording paper is fed in its longitudinal direction (when, as is shown by the central arrow in FIG. 14(*a*), a document is vertically scanned). (2) m=0.92 where A4 or B5-size recording paper is fed in its longitudinal direction. (3) m=0.90 where A4, B5 or B6-size recording paper is fed in the direction perpendicular to its longitudinal direction.

In order to perform a copying operation with such a magnification m, a procedure is made to focus an image with magnification m on photoreceptor drum 20 by means of (1) changing the focal length of principal lens 16 and moving the position of the lens, (2) moving both principal lens 16 and second mirror unit 15, or (3) changing the focal length of principal lens 16 and moving second mirror unit 15, or the like. The change of the focal length of principal lens 16 is carried out by use of a zoom lens as the principal lens 16 or by use of an attachment lens to the lens. Moving the optical unit to the magnification m position is carried out by use of a pulse motor. For example, a home position sensor is provided, which, from its position, controls the pulse motor to thereby move the optical unit to the magnification m position.

Thus, the optical unit, as of projection magnification m onto photoreceptor drum 20, moves to its initial position, and changes the scanning speed of first mirror unit 12 to 1/m. A copy image thus obtained has no partial missing in the text of document information due to the insertion of an additional information.

The copy image obtained by the above construction-having copying apparatus. if no additional information image is recorded, is the same as conventional, ordinary one, but, where a date or number is recorded, the additional information image is copied together with the text image of document information on a same sheet of recording paper. And where the additional information recording is made, the document information image is somewhat reduced and printed in the well-balanced form.

Futher, in the number recording mode, a number serially increasing each time when one copy is made can be recorded as is shown in FIG. 20(*a*), and a number to be serially counted down each time of copying can also be recorded as is shown in FIG. 20(*b*). In the latter, if the number of document sheets to be copied is coincident with the number set, the number printed on each copy becomes its page number, and thus automatic pagenation can be carried out. In addition, the above example is of copying with use of recording paper sheets of the same size as document size, but where the size is different, the above reduction magnification should be added to conventional change of magnification. And, as means of displaying an additional information, an example where a reflection-type liquid crystal is used has been described above, but one in which a transmission-type liquid crystal with its back provided with a light source may be used, or ECD (electrochromic display), etc., may also be used.

As has been described above, according to the present invention, because a document information image is reduced to be copied, it causes no missing in document information, and also because the reduction magnification is provided so as to be changeable according to the paper size used, a well-balanced composite image can be obtained.

What is claimed is:

1. An image recording apparatus for composing plural partial orginal images into a single composite image, comprising:

a photoreceptor;

charging means for charging said photoreceptor;

first exposing means for forming an orginal image on the charged photoreceptor, thereby obtaining an image forming area;

second exposing means for neutralizing an area of the charged photoreceptor, thereby obtaining an image eliminating area corresponding to a neutralized area of the photoreceptor;

area control means for controlling said second exposing means in accordance with a boundary input defining a boundary between the image forming area and the image eliminating area;

recording means for recording a partial image obtained from the image forming area;

operating means for operating said charging means, said first and second exposing means, said area control means and said recording means at least two times to carry out at least first and second composing operations in accordance with the boundary input, said operating means including:

(a) means for carrying out said first composing operation such that a first image forming area and a first image eliminating area are formed on the charged photoreceptor and then a first partial image is recorded; and (b) means for carrying out said second composing operation such that said second exposing means is controlled in the reverse mode relative to the first composing operation, whereby a second image forming area is formed on the area corresponding to the first image eliminating area, a second image eliminating area is formed on the area corresponding to the first image forming area and then a second partial image is so recorded as to be composed with said first partial image; and said second exposing means including means for shifting at least either one of said first boundary between the first image forming area and the first image eliminating area or the second boundary between the second image forming area and the second image eliminating area from the inputted boundary, thereby avoiding an overlap image across the first partial image and the second partial image.

2. The image recording apparatus of claim 1, including means for inputting an image priority input for selecting either one of the first partial image or the second partial image to said area control means in addition to said boundary input, for shifting either one of the first boundary or the second boundary from the inputted boundary.

3. The image recording apparatus of claim 1, wherein said second exposing means includes means for neutralizing a wider area than that of the boundary input.

4. The image recording apparatus of claim 3, wherein said second exposing means comprises at least one light emitting diode which is arranged such that a light emitting surface thereof is spaced from about 1 to about 5 mm from said photoreceptor.

5. The image recording apparatus of claim 1, wherein said area control means includes means for changing said boundary input, which corresponds to said image eliminating area, according to information of at least either one of a size of a recording paper and a magnification used in image recording.

6. The image recording apparatus of claim 5, wherein one of said information is displayed on a display device.

7. The image recording apparatus of claim 6, wherein said display device comprises a liquid crystal display device.

8. The image recording apparatus of claim 5, wherein said area control means includes means for changing the exposure extend of a charge eliminating lamp to thereby change said image eliminating area.

9. The image recording apparatus of claim 1, wherein said second exposing means comprises a charge eliminating lamp.

10. The image recording apparatus of claim 1, wherein said second exposing means comprises a light emission element array which is arranged spaced from about 1 to about 5 mm from said image carrier.

11. The image recording apparatus of claim 10, wherein said light emission element array comprises an array of light emitting diodes.

12. A method for composing plural partial original images into a single composite image, in an image recording apparatus, the image recording apparatus comprising a photoreceptor; and charging means for charging said photoreceptor; the method comprising:

forming an original image on the charged photoreceptor responsive to an output of a first exposing means, thereby obtaining an image forming area;

neutralizing an area of the charged photoreceptor in accordance with an output of a second exposing means, thereby obtaining an image eliminating area corresponding to a neutralized area of the photoreceptor;

controlling said second exposing means in accordance with a boundary input defining a boundary between the image forming area and the image eliminating area;

recording a partial image obtained from the image forming area;

operating said charging means, said first and second exposing means, said area control means and said recording means at least two times to carry out at least first and second composing operations in accordance with the boundary input;

said first composing operating comprising forming a first image forming area and a first image eliminating area on the charged photoreceptor and then recording a first partial image;

said second composing operation comprises controlling said second exposing means in a reverse mode relative to the first composing operation, and forming a second image forming area on the area corresponding to the first image eliminating area, forming a second image eliminating area on the area corresponding to the first image forming area and then recording a second partial image composed with said first partial image; and shifting at least either one of said first boundary between the first image forming area and the first image eliminating ara or the second boundary between the second image forming area and the second image eliminating area from the inputted boundary, thereby avoiding an overlap image across the first partial image and the second partial image.

13. The composing method of claim 12, including inputting an image priority input for selecting either one of the first partial image or the second partial image to said area control means in addition to said boundary input, for shifting either one of the first boundary or the second boundary from the inputted boundary.

14. The composing method of claim 12, wherein said neutralizing step comprises neutralizing a wider area than that of the boundary input.

15. The composing method of claim 14, wherein said neutralizing step comprises illuminating said photoreceptor by a light source having a light emitting surface spaced from about 1 to about 5 mm from said photreceptor.

16. The composing method of claim 12, comprising controlling said second exposing means by changing said boundary input, which corresponds to said image eliminating area, according to information of at least either one of a size of a recording paper and a magnification used in image recording.

17. The composing method of claim 16, comprising displaying one of said information on a display device.

18. The composing method of claim 16, comprising controlling said second exposing means by changing the exposure extend of a charge eliminating lamp to thereby change said image eliminating area.

19. The composing method of claim 12, wherein said second exposing means comprises exposing by a light emission element array which is arranged spaced from about 1 to about 5 mm from said photoreceptor.

20. The composing method of claim 19, wherein said light emission element array comprises an array of light emitting diodes.

* * * * *